US010903540B2

(12) United States Patent
Hendry

(10) Patent No.: US 10,903,540 B2
(45) Date of Patent: Jan. 26, 2021

(54) DUAL-MODE CORRUGATED WAVEGUIDE CAVITY FILTER

(71) Applicant: Nokia Solutions and Networks Oy, Espoo (FI)

(72) Inventor: David Hendry, New Providence, NJ (US)

(73) Assignee: Nokia Solutions and Networks Oy, Espoo (FI)

( * ) Notice: Subject to any disclaimer, the term of this patent is extended or adjusted under 35 U.S.C. 154(b) by 0 days.

(21) Appl. No.: 16/427,905

(22) Filed: May 31, 2019

(65) Prior Publication Data

US 2020/0381796 A1 Dec. 3, 2020

(51) Int. Cl.

| | |
|---|---|
| ***H01P 1/208*** | (2006.01) |
| ***H01P 7/06*** | (2006.01) |
| ***H01P 3/16*** | (2006.01) |
| ***H01P 7/10*** | (2006.01) |

(52) U.S. Cl.

CPC ..... *H01P 1/2086* (2013.01); *H01P 3/16* (2013.01); *H01P 7/06* (2013.01); *H01P 7/105* (2013.01)

(58) Field of Classification Search

CPC .. H01P 1/2086; H01P 3/16; H01P 7/06; H01P 7/105

USPC ..... 333/202

See application file for complete search history.

(56) References Cited

U.S. PATENT DOCUMENTS

| | | | |
|---|---|---|---|
| 4,639,699 | A | 1/1987 | Nishikawa et al. |
| 2003/0076200 | A1 | 4/2003 | Fiedziuszko et al. |
| 2014/0320237 | A1 | 10/2014 | Pacaud et al. |
| 2015/0236428 | A1 | 8/2015 | Caratelli et al. |

FOREIGN PATENT DOCUMENTS

| | | | |
|---|---|---|---|
| EP | 2228579 | A2 | 9/2010 |
| JP | S61-103301 | A | 5/1986 |
| WO | 2016185196 | A1 | 11/2016 |

OTHER PUBLICATIONS

A.E. Centeno and P.S. Excell, High Q Dielectrically Loaded Electrically Small Cavity Resonator, Jun. 1993, IEEE Microwave and Guided Wave Letters, vol. 3 No. 6 , pp. 173-174 (Year: 1993).*

(Continued)

*Primary Examiner* — Robert J Pascal
*Assistant Examiner* — Kimberly E Glenn
(74) *Attorney, Agent, or Firm* — Chiesa Shahinian & Giantomasi PC

(57) ABSTRACT

A filter comprises a dielectric resonator element and a cylindrical waveguide cavity having a corrugated tube structure that surrounds the dielectric resonator element such that an outer encircling wall surface of the dielectric resonator element is in contact with an inner sidewall of the corrugated tube structure. The corrugated tube structure includes one or more spaced-apart corrugations configured to provide a spring-like action to controllably expand and contract the corrugated tube structure so that the dielectric resonator element can be controllably inserted and clamped within the cylindrical waveguide cavity. The geometry of the spaced-apart corrugations can be selected to define a rotationally asymmetric corrugated tube structure configured to split a plurality of fundamental modes of electromagnetic waves within the filter.

14 Claims, 3 Drawing Sheets

(56) References Cited

OTHER PUBLICATIONS

Bakr et al., "A Novel Dielectric-Loaded Dual-Mode Cavity for Cellular Base Station Applications," Proceedings of the 46th European Microwave Conference, Oct. 2016, 4 pgs.
Williams, "A Four-Cavity Elliptic Waveguide Filter," IEEE Transactions on Microwave Theory and Techniques, Dec. 1970, vol. MTT-18, No. 12, pp. 1109-1114.
Fiedziuszko, "Dual-Mode Dielectric Resonator Loaded Cavity Filters," IEEE Transactions on Microwave Theory and Techniques, Sep. 1982, vol. 30, No. 9, pp. 1311-1316.
Lech et al., "Circular Resonator with Corrugated Cylinders," International Conference on Microwaves, Radar & Wireless Communications, May 2006, 4 pgs.
Fakhte et al., "Rectangular Dielectric Resonator Antenna With Corrugated Walls," IEEE Access, Dec. 2018, vol. 7., pp. 3422-3429.
Ibrahim, "A Dielectric Resonator Antenna Over Corrugated Ground Plane with Metallic and Nonmetallic Metamaterial Superstrates," 11th European Conference on Antennas and Propagation (EUCAP), Mar. 2017, pp. 3031-3031.
Extended European Search Report dated Oct. 22, 2020, in connection with European Patent Application No. 20177007.0, 10 pgs.

* cited by examiner

DUAL-MODE CORRUGATED WAVEGUIDE CAVITY FILTER

TECHNICAL FIELD

The present invention relates generally to waveguide filters, and more particularly to dual-mode waveguide cavity filters utilizing corrugated tubing structures.

BACKGROUND

Microwave components, such as passive radio frequency (RF) filters, play an important role in wireless communications. For example, RF filters are commonly used to pass only the desired frequencies from the radio to the antenna (and from the antenna to the radio), while blocking spurious transmissions that can otherwise saturate a receiver. Given the density and co-location of equipment at cell sites, component size has become a critical factor. Dual-mode ceramic waveguide filters are particularly useful for such applications given their filtering performance (e.g., ability to easily and simply generate transmission zeros) as well as reduced component size as compared with other filters, such as traditional air coaxial filters, for example.

However, reducing the size of traditional dual-mode waveguide filters can give rise to other disadvantages relating to performance tradeoffs, cost, as well as manufacturing and component assembly issues. For example, a filter assembly can be made more compact by suspending the dielectric element (e.g., ceramic "puck") inside the filter cavity and extending the dielectric element to the cavity walls. In this arrangement, the dielectric element would require perturbing structures to "break" the degeneracy of the dual modes (e.g., split the frequencies of the otherwise degenerate dual modes) and to define the filter bandwidth (e.g., the more the modes are split, the greater the bandwidth of the filter, etc.). Adding such perturbing structures can increase the overall cost of producing the dielectric element. Additionally, such filter assemblies have added manufacturing and assembly complexity. For example, strict tolerances (e.g., bore and cylinder diameters, temperature variances) make it very difficult to insert and hold, without damage, a ceramic puck inside a rigid cavity when using either mechanical processes (e.g., hydraulic pressing) or temperature-controlled processes (e.g., heating/cooling to effect expansion and contraction of the rigid metal cavity).

SUMMARY

In accordance with various embodiments, a compact size waveguide filter utilizes a corrugated tubing structure that allows a dielectric element to be controllably pressed and clamped within a waveguide cavity. A distribution of corrugations provides a cavity structure that can be expanded and contracted without the challenges associated with adhering to strict tolerances (e.g., bore diameter) and controlling temperature variations in a heating/cooling process. The corrugated tubing structure acts as a spring to ease the insertion of the dielectric element and provides a clamping force to hold the dielectric element in place. The geometry of the corrugations in the tubing structure can provide rotational asymmetry to split dual-mode resonant frequencies using an unperturbed dielectric, thus avoiding the cost of adding perturbing structures within the waveguide cavity.

In accordance with an embodiment, a filter comprises a dielectric resonator element (e.g., a ceramic resonator) and a cylindrical waveguide cavity having a corrugated tube structure that surrounds the dielectric resonator element such that an outer encircling wall surface of the dielectric resonator element is in contact with an inner sidewall of the corrugated tube structure. The corrugated tube structure includes one or more spaced-apart corrugations that are configured to provide a spring-like action to controllably expand and contract the corrugated tube structure (e.g., the diameter of the tube) so that the dielectric resonator element can be controllably inserted and clamped within the cylindrical waveguide cavity. According to an embodiment, the geometry of the spaced-apart corrugations define a rotationally asymmetric corrugated tube structure capable of splitting a plurality of modes of electromagnetic waves within the filter, e.g., a first resonant mode and a second substantially degenerate resonant mode in a dual-mode filter configuration. According to another embodiment, the geometry of the spaced-apart corrugations define a rotationally symmetric corrugated tube structure and the dielectric resonator element includes one or more perturbing elements (e.g., "through" holes in the ceramic resonator) for splitting a plurality of modes of electromagnetic waves within the filter. In different embodiments, the spaced-apart corrugations can take the form of half-cylinders, half-squares, triangles, rectangles and various other shapes capable of providing the spring-like action on the corrugated tube structure. The dielectric resonator element can also include a chamfered edge (e.g. on a top and/or bottom surface) to ease insertion into the cavity.

DETAILED DESCRIPTION

Various illustrative embodiments will now be described more fully with reference to the accompanying drawings in which some of the illustrative embodiments are shown. It should be understood, however, that there is no intent to limit illustrative embodiments to the particular forms disclosed, but on the contrary, illustrative embodiments are intended to cover all modifications, equivalents, and alternatives falling within the scope of the claims. Where appropriate, like numbers refer to like elements throughout the description of the figures. It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of illustrative embodiments. As used herein, the term "and/or" includes any and all combinations of one or more of the associated listed items.

Figure 1:
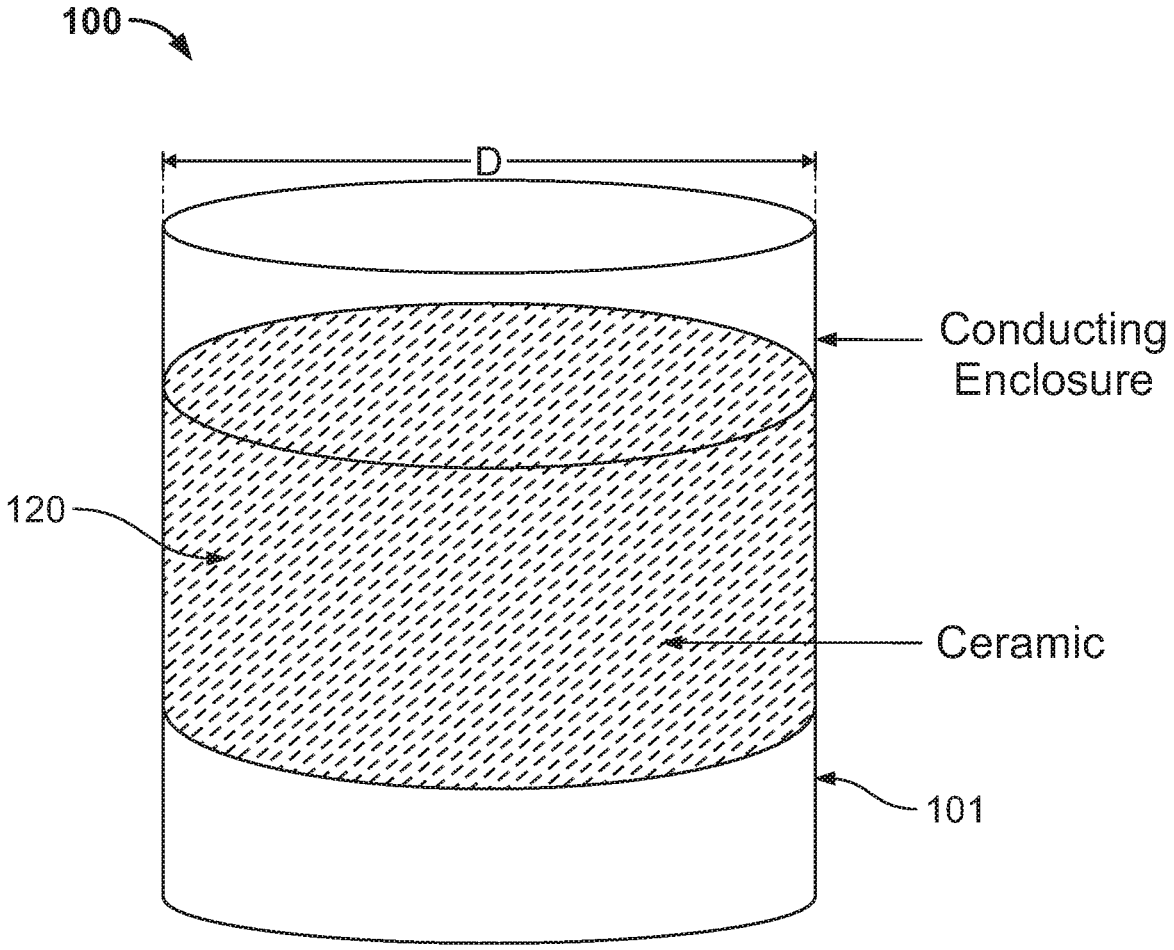
FIG. 1 shows a filter configuration.

FIG. 1 shows a filter assembly 100 in which a dielectric element 120 (e.g., cylindrical ceramic puck) is suspended within cavity 101. As shown, dielectric element 120 extends to the walls of cavity 101. In this arrangement, dielectric element 120 could be mechanically pressed into cavity 101, which would be dependent on the malleability of the metal to allow for insertion of dielectric element 120 and with the requisite resistance and force to hold dielectric element 120 in place. Tight tolerances may also need to be observed with respect to bore diameter D, for example, to ensure the proper insertion and holding force can be achieved. Alternatively, dielectric element 120 can be inserted into cavity 101 utilizing a temperature-controlled process that involves, for example, applying heat to expand metallic cavity 101, inserting the dielectric element 120, followed by a cooldown to contract metallic cavity 101 to clamp down dielectric element 120 (e.g., a "cool-shrink" process). However, managing the wide range of temperature variations requires a high degree of precision and control to ensure an appropriate degree of holding force can be achieved at the end of the cool-shrink process while avoiding any damage to dielectric element 120 in the process, which can lead to degradation of performance of dielectric element 120. Another disadvantage with this arrangement is that filter assembly 100 requires perturbing structures to split the degenerate dual-mode frequencies. For example, "through" holes/slots would need to be added in dielectric element 120 or tuning screws inserted in cavity 101, which can add cost and complexity to the manufacturing and assembly of filter assembly 100.

Figure 2A:
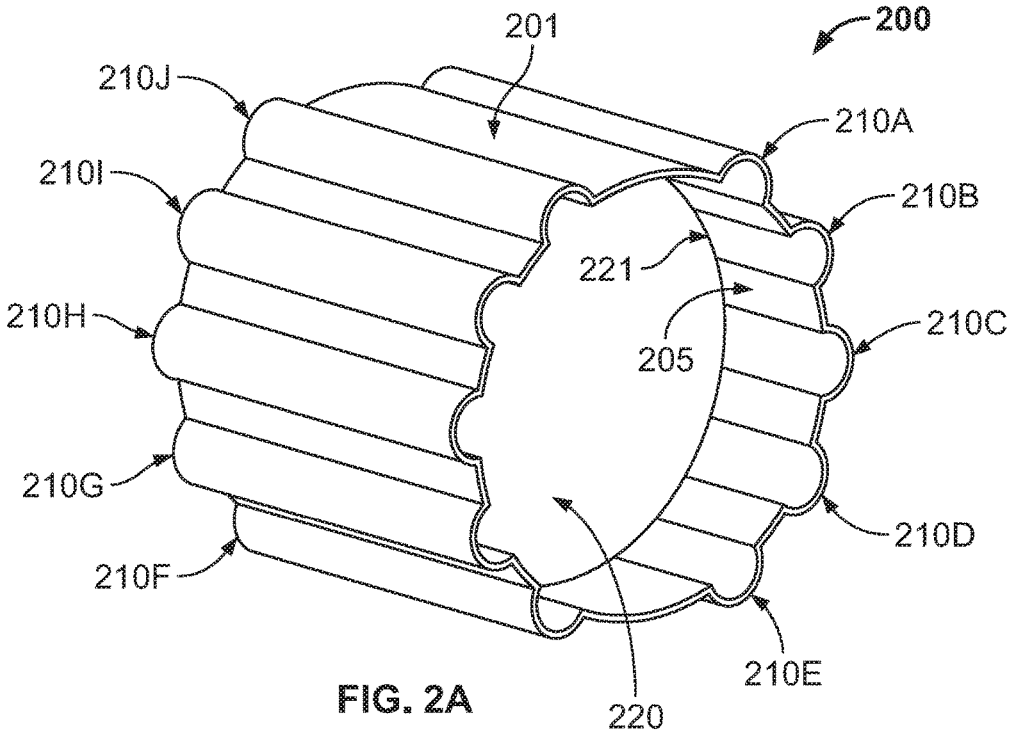
FIG. 2A shows a perspective view of a dual-mode waveguide filter according to an illustrative embodiment.
Figure 2B:
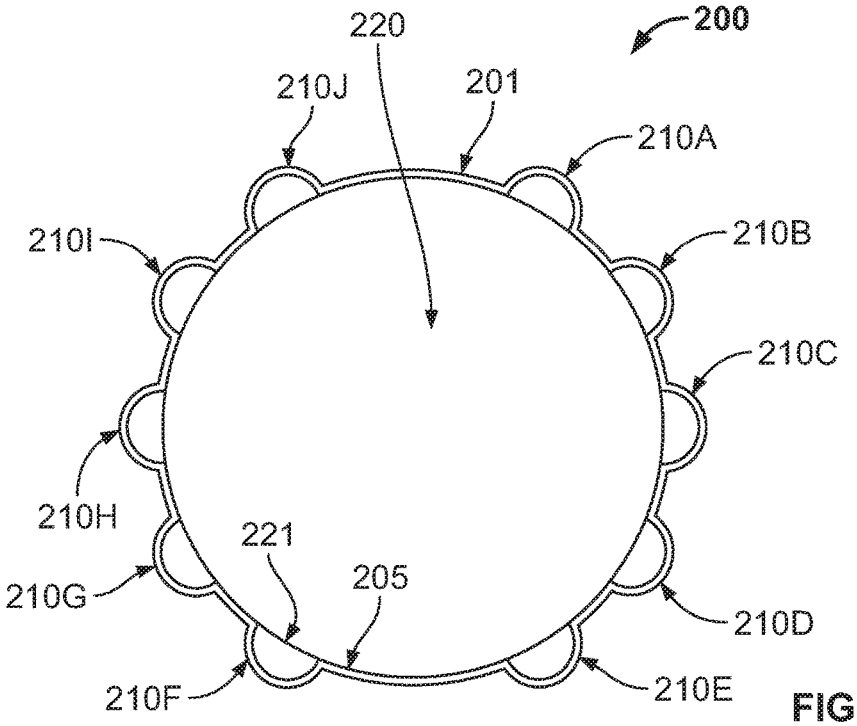
FIG. 2B shows a top plan view of the dual-mode waveguide filter from FIG. 2A.

FIG. 2A (perspective view) and FIG. 2B (top view) show an illustrative embodiment of waveguide filter 200 that includes dielectric resonator element 220 inserted (disposed) within a cylindrical waveguide cavity defined by a corrugated tube structure 201. In this embodiment, corrugated tube structure 201 includes an inner (interior) sidewall 205 and a plurality of spaced-apart corrugations 210A, 210B, 210C, 210D, 210E, 210F, 210G, 210H, 210I and 210J (collectively referred to as 210A-210J) distributed around the circumference of corrugated tube structure 201. As shown, corrugated tube structure 201 surrounds dielectric resonator element 220 such that outer encircling wall surface 221 of dielectric resonator element 220 is in contact with inner sidewall 205 of corrugated tube structure 201.

According to an embodiment, corrugated tube structure 201 is a metal tube (e.g., aluminum, aluminum alloy, silver-plated steel, copper or other suitable metal) and dielectric resonator element 220 is an unperturbed ceramic resonator (e.g., without structure for "breaking" the degeneracy of the resonant modes). The spaced-apart corrugations 210A-210J allow corrugated tube structure 201 to be deformably expanded and contracted to allow for insertion of dielectric resonator element 220 therein. In particular, the inclusion of spaced-apart corrugations 210A-210J along corrugated tube structure 201 provides resilience in the structure such that it acts like a spring (e.g., provides a spring-like action) that controllably expands and contracts corrugated tube structure 201 so that dielectric resonator element 220 can be controllably inserted and clamped within the cylindrical waveguide cavity. In this manner, the spring-like action of corrugated tube structure 201 eases the insertion of dielectric resonator element 220 as well as serves as a controlled clamping force to hold the dielectric resonator element 220 in place. Although not shown, dielectric resonator element 220 can have chamfered edges (or even slightly chamfered edges) along the periphery of its top and/or bottom end surfaces (not shown), which can aid with the insertion of dielectric resonator element 220 into corrugated tube structure 201.

In general, the spaced-apart corrugations 210A-210J define a series of alternating grooves and ridges (or ribs) around the circumference of corrugated tube structure 201. According to an embodiment, the geometrical shape (e.g., cross-section) of the spaced-apart corrugations 210A-201J can be half-cylinders (as shown in FIGS. 2A and 2B). Alternatively, the spaced-apart corrugations 210A-201J could take the form of half-squares, rectangles, triangles, or any shape that allows the diameter of the corrugated tube structure 201 to controllably expand and contract. Each of the spaced-apart corrugations 210A-210J extend outwardly in a direction away from a central portion (or longitudinal axis) of the cylindrical waveguide cavity. Well-known techniques can be utilized to form the various geometrical shape and structure of corrugated tube structure 201 with spaced-apart corrugations 210A-210J, e.g., via extrusion, machined out of a larger, outer cylindrical cavity, and so on.

The number and positioning of spaced-apart corrugations 201A-201J to be included along the circumference of corrugated tube structure 201 is a matter of design choice and may be selected dependent on physical and/or functional performance requirements for waveguide filter 200. As will be apparent, less spaced-apart corrugations may provide less spring-like action while more spaced-apart corrugations will increase the range of the spring-like action (e.g., larger expansion and contraction range). Although the illustrative embodiments shown herein include ten (10) spaced-apart corrugations, even a single corrugation can provide the necessary functionality for waveguide filter 100.

According to an embodiment, waveguide filter 200 is rotationally asymmetric in that the geometry of the one or more spaced-apart corrugations 201A-201J define a rotationally asymmetric corrugated tube structure 201 that is configured to split a plurality of fundamental modes of electromagnetic waves propagating within waveguide filter 200. As used herein, the term rotationally asymmetric is to be understood to refer to a structure in which corrugations are, at least in part, non-uniformly distributed along the circumference of corrugated tube structure 201. For example, waveguide filter 200 in one embodiment is a dual-mode filter that splits dual-mode frequencies, e.g., a first resonant mode and a second substantially degenerate resonant mode. Because rotational asymmetry is provided via the corrugated structure in the cylindrical waveguide structure itself, dielectric resonator element 220 can therefore be an unperturbed ceramic, e.g., no perturbations are required in the ceramic puck.

Figure 3A:
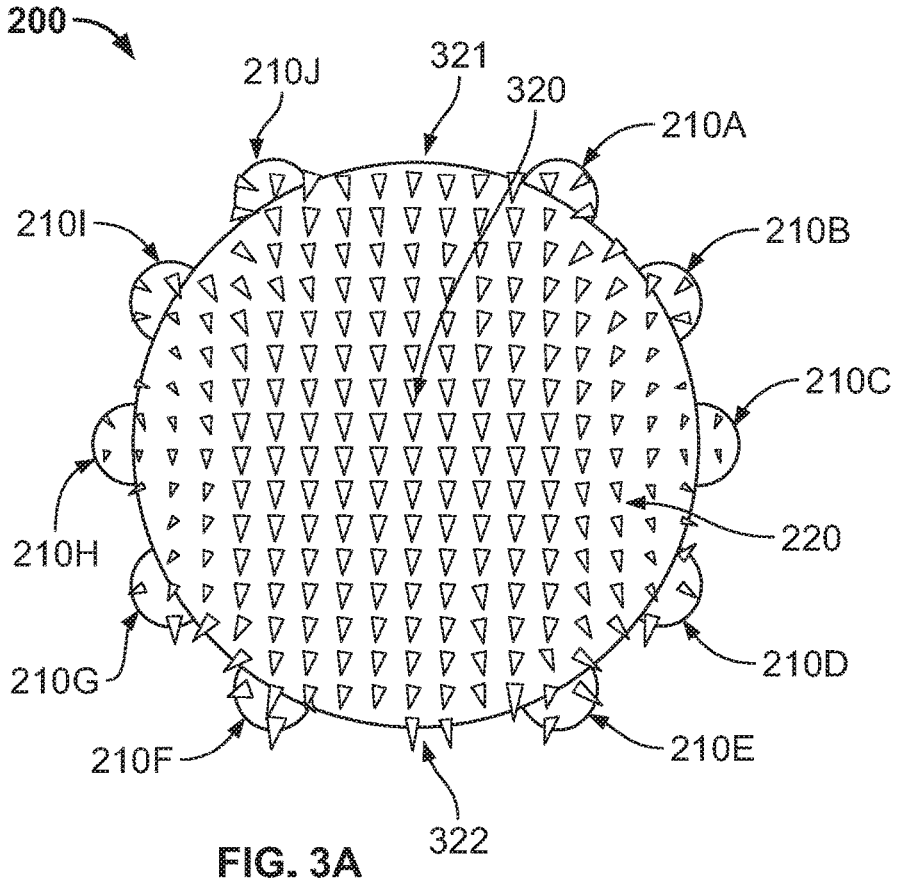
FIGS. 3A and 3B show the orthogonally polarized electric fields of two split modes propagating in a dual-mode waveguide filter according to an illustrative embodiment.
Figure 3B:
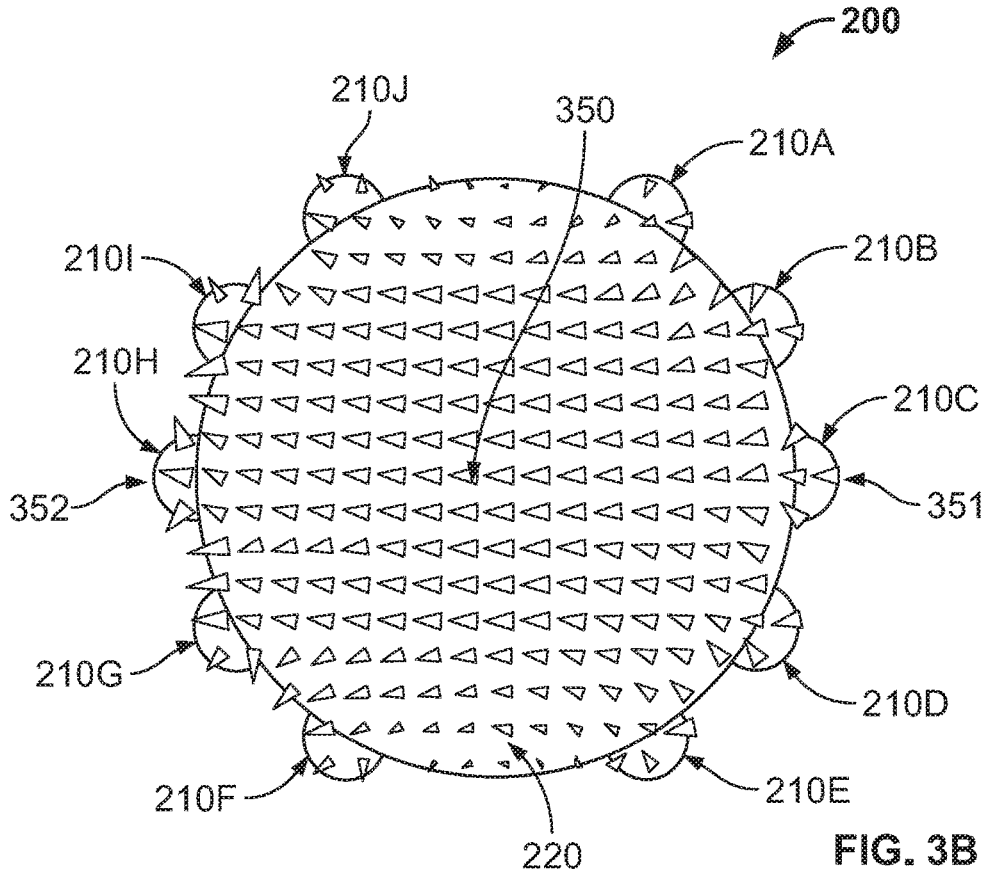

FIGS. 3A and 3B demonstrate the rotational asymmetry achieved with waveguide filter 200 from FIGS. 2A and 2B. In particular, FIGS. 3A and 3B show the respective electric fields of two split modes according to an embodiment. More specifically, FIG. 3A shows electric field 320 with reference 321 indicating a "top" and reference 322 indicating a "bottom" of the electric field 320 relative to the top view waveguide filter 200. Similarly, FIG. 3B shows electric field 350 with reference 351 indicating a "top" and reference 352 indicating a "bottom" of the electric field 350 relative to the top view of waveguide filter 200. In the examples shown in FIGS. 3A and 3B, the electric fields were generated using a 35 mm OD (outside diameter) dielectric with a height of 12 mm and a permittivity of Er78 with fundamental modes at 870 MHz (FIG. 3A) and 890 MHz (FIG. 3B). This example is only illustrative and not limiting in any manner.

When viewed in the context of an x-y axis perspective for a top view of waveguide filter 200, FIG. 3A shows electric field 320 polarized in the vertical direction, e.g., from "top" position 321 to "bottom" position 322, while FIG. 3B shows electric field 350 polarized in the horizontal direction, e.g., from "top" position 351 to "bottom" position 352. Rotational asymmetry is achieved in this embodiment because each mode (FIGS. 3A and 3B) "sees" the structure of waveguide filter 200 differently. For example, the resonant mode in FIG. 3A does not "see" a corrugated "bump" at positions 321 or 322 of electric field 320, while in FIG. 3B, the resonant mode "sees" corrugated "bump" 210C at the position 351 of electric field 350 and corrugated "bump" 210H at the position 352 of electric field 350. Because each mode "sees" the structure differently, the current path lengths for each mode will be different and therefore their resonant frequencies will be different. For example, the current for the mode in FIG. 3A must travel from position 321 to position 322, traversing every "bump" therebetween. By comparison, the current for the mode in FIG. 3B traverses fewer bumps traveling from position 351 to position 352, and therefore has a shorter path length and a higher resonant frequency.

The spaced-apart corrugations 210A-210J are incorporated in a manner that provides the rotational asymmetry in corrugated tube structure 201, e.g., the number and positioning/spacing of spaced-apart corrugations 210A-210J. For example, rotational asymmetry is not present (i.e., the modes remain degenerate) when the corrugations repeat at 360/N degrees where N>2 and where N is an integer representing the number of corrugations.

As described, the number and positioning of spaced-apart corrugations 201A-201J to be included along the circumference of corrugated tube structure 201 is a matter of design choice and may be selected dependent on physical and/or functional performance requirements for waveguide filter 200. For example, the number of corrugations can also affect the mode-splitting performance of waveguide filter 200. As will be apparent, a lesser number of spaced-apart corrugations may enhance mode-splitting performance while a greater number of spaced-apart corrugations may reduce the mode-splitting performance in waveguide filter 200. That is, the more asymmetry that exists, the more the modes will be split.

In another embodiment, the geometry of corrugated tube structure 201 can also be rotationally symmetric, but in this case, perturbations would be incorporated into dielectric resonator element 220 (e.g., "through" holes as perturbing elements) to effectively split the fundamental modes of electromagnetic waves propagating within waveguide filter 200, e.g., dual-mode frequencies for a dual-mode filter.

The foregoing merely illustrates the principles of the disclosure. It will thus be appreciated that those skilled in the art will be able to devise various arrangements that, although not explicitly described or shown herein, embody the principles of the disclosure and are included within its spirit and scope. Furthermore, all examples and conditional language recited herein are principally intended to be only for pedagogical purposes to aid the reader in understanding the principles of the disclosure and the concepts contributed by the inventor to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future.

What is claimed is:

1. A filter comprising:

a dielectric resonator element; and a corrugated tube structure that surrounds the dielectric resonator element such that an outer wall surface of the dielectric resonator element is in contact with an inner sidewall of the corrugated tube structure, the corrugated tube structure including one or more spaced-apart corrugations configured to provide resilience to controllably expand and contract the corrugated tube structure so that the dielectric resonator element can be controllably inserted and clamped within the corrugated tube structure.

2. The filter according to claim 1, wherein the one or more spaced-apart corrugations are non-uniformly positioned on the corrugated tube structure and are configured to split a plurality of fundamental modes of electromagnetic waves within the filter.

3. The filter according to claim 2, wherein the filter is a dual-mode filter and the corrugated tube structure facilitates splitting of a first resonant mode and a second substantially degenerate resonant mode.

4. The filter according to claim 1, wherein each of the one or more spaced-apart corrugations comprises a surface that extends outwardly from a central portion of the corrugated tube structure.

5. The filter according to claim 4, wherein the one or more spaced-apart corrugations have a cross-section comprising one of half-cylinders, half-squares, triangles, and rectangles.

6. The filter according to claim 1, wherein the dielectric resonator element comprises an unperturbed ceramic resonator and the corrugated tube structure comprises a metal tube wherein the metal is one of aluminum, an aluminum alloy, silver-plated steel, and copper.

7. A filter comprising:

a cylindrical waveguide structure including a cavity defined by an interior sidewall having one or more spaced-apart corrugations, each of the one or more spaced-apart corrugations comprising a surface that extends outwardly from a central portion of the cylindrical waveguide structure; and a dielectric resonator element disposed within the cylindrical waveguide structure such that an outer wall surface of the dielectric resonator element remains in contact with the interior sidewall of the cylindrical waveguide structure, wherein the one or more spaced-apart corrugations are non-uniformly positioned on the cylindrical waveguide structure configured to split a plurality of fundamental modes of electromagnetic waves within the filter.

8. The filter according to claim 7, wherein the filter is a dual-mode filter and the cylindrical waveguide structure facilitates splitting of a first resonant mode and a second substantially degenerate resonant mode.

9. The filter according to claim 7, wherein the one or more spaced-apart corrugations have a cross-section comprising one of half-cylinders, half-squares, triangles, and rectangles.

10. A dual-mode filter comprising:

a corrugated tube structure including one or more non-uniformly spaced-apart corrugations; and a dielectric resonator element disposed in the corrugated tube structure such that an outer wall surface of the dielectric resonator element is surrounded by and in contact with the corrugated tube structure, wherein the one or more spaced-apart corrugations are configured to provide resilience to controllably expand and contract the corrugated tube structure so that the dielectric resonator element can be controllably inserted and clamped within the corrugated tube structure.

11. The dual-mode filter according to claim 10, wherein the corrugated tube structure is configured to split a first resonant mode and a second substantially degenerate resonant mode.

12. The dual-mode filter according to claim 10, wherein each of the one or more spaced-apart corrugations comprises a surface that extends outwardly from a central portion of the corrugated tube structure.

13. The dual-mode filter according to claim 12, wherein the one or more spaced-apart corrugations have a cross-section comprising one of half-cylinders, half-squares, triangles, and rectangles.

14. The dual-mode filter according to claim 10, wherein the dielectric resonator element comprises an unperturbed ceramic resonator and the corrugated tube structure comprises a metal tube wherein the metal is one of aluminum, an aluminum alloy, silver-plated steel, and copper.

* * * * *